US009533498B2

(12) United States Patent
Goto et al.

(10) Patent No.: US 9,533,498 B2
(45) Date of Patent: Jan. 3, 2017

(54) PRINTING METHOD AND PRINTING DEVICE

(71) Applicant: MURATA MANUFACTURING CO., LTD., Kyoto-fu (JP)

(72) Inventors: Seiji Goto, Kyoto-fu (JP); Tomoyuki Morii, Kyoto-fu (JP); Futoshi Murakami, Kyoto-fu (JP)

(73) Assignee: Murata Manufacturing Co., Ltd., Kyoto-Fu (JP)

( * ) Notice: Subject to any disclaimer, the term of this patent is extended or adjusted under 35 U.S.C. 154(b) by 0 days.

(21) Appl. No.: 14/607,381

(22) Filed: Jan. 28, 2015

(65) Prior Publication Data

US 2015/0224762 A1 Aug. 13, 2015

(30) Foreign Application Priority Data

Feb. 7, 2014 (JP) ..... 2014-021998

(51) Int. Cl.
*B41J 2/045* (2006.01)

(52) U.S. Cl.
CPC ..... *B41J 2/04573* (2013.01); *B41J 2/04581* (2013.01)

(58) Field of Classification Search
CPC ..... B41J 2/045; B41J 2/04501; B41J 2/04573; B41J 2/04588; B41J 2/04591; B41J 2/0455; B41J 2/04541
See application file for complete search history.

(56) References Cited

U.S. PATENT DOCUMENTS 4,431,690 A 2/1984 Matt et al.
2004/0017411 A1* 1/2004 Usuda ..... B41J 2/04541 347/9
2013/0286075 A1 10/2013 Tamiya et al.
2015/0210098 A1 7/2015 Tamiya et al.

FOREIGN PATENT DOCUMENTS

JP 59-359 1/1984
JP H11-170496 A 6/1999
(Continued)

OTHER PUBLICATIONS

An Office Action issued by the Japanese Patent Office on Dec. 1, 2015, which corresponds to Japanese Patent Application No. 2014-021998 and is related to U.S. Appl. No. 14/607,381; with English language.

(Continued)

*Primary Examiner* — Geoffrey Mruk
*Assistant Examiner* — Scott A Richmond
(74) *Attorney, Agent, or Firm* — Studebaker & Brackett PC

(57) ABSTRACT

A printing method and a printing device, in which printing quality can be maintained without increasing time necessary for printing even if resolution is enhanced. In the printing method, a reference signal is sent at intervals shorter than a minimum time interval at which an ink head provided with plural nozzles can eject ink, at least two reference signals set longer than the minimum time interval are counted as one count, the ink is ejected every one count, and a print pattern is formed by collectivity of the ejected ink. At least a final one count used to form the print pattern is adjusted so as to be lengthened by one or plural reference signals, and the ink is ejected every one count.

12 Claims, 10 Drawing Sheets

(56) References Cited

FOREIGN PATENT DOCUMENTS

| | | | |
|---|---|---|---|
| JP | 2002-028552 | A | 1/2002 |
| JP | 2006-088712 | A | 4/2006 |
| JP | 2009-113426 | A | 5/2009 |
| JP | 2009-292017 | A | 12/2009 |
| JP | 2013-139009 | A | 7/2013 |
| JP | 2013-237251 | A | 11/2013 |
| JP | 2013-240991 | A | 12/2013 |

OTHER PUBLICATIONS

An Office Action; "Notice of Reasons for Rejection," issued by the Japanese Patent Office on Jul. 5, 2016, which corresponds to Japanese Patent Application No. 2014-021998 and is related to U.S. Appl. No. 14/607,381; with English language translation.

* cited by examiner

PRINTING METHOD AND PRINTING DEVICE

CROSS REFERENCE TO RELATED APPLICATION

This application claims benefit of priority to Japanese Patent Application No. 2014-021998 filed Feb. 7, 2014, the entire content of which is incorporated herein by reference.

TECHNICAL FIELD

The present invention relates to a printing method and a printing device, in which ink is ejected from a nozzle of an ink head to perform printing.

BACKGROUND

A printing device that performs printing by ejecting ink from a nozzle of an ink head ejects an ink drop to a surface of a workpiece arranged below the ink head. For example, the workpiece is placed on an X-Y table, and the workpiece and the ink head move relatively in an X-axis direction and a Y-axis direction orthogonal to the X-axis direction. The X-Y table may move and the ink head may move.

During the relative movement between the workpiece and the ink head, the ink drop is ejected from the ink head to perform the printing on the surface of the workpiece. Through an inkjet system, a desired print pattern (functional film) is printed while ink drop ejection timing is controlled, thereby producing an electronic component, an electronic device, and an electronic instrument (for example, see Japanese Patent Publication Laid-Open No. 2009-292017).

In the case that the printing is performed by the inkjet system, printing speed depends on resolution. FIGS. 10A to 10C are conceptual views illustrating a relationship between the resolution and the printing speed in a conventional printing device.

As illustrated in FIGS. 10A to 10C, it is necessary to consider the resolution in a moving direction of an ink head 2 and the resolution in an array direction of nozzles 21 of the ink head 2. The resolution in the array direction of the nozzles 21 of the ink head 2 is uniquely decided by an arrangement structure of the nozzles 21. On the other hand, the resolution in the moving direction of the ink head 2 is decided based on an ejection frequency (an inverse of an ejection time interval) of the ink drop and printing speed (relative speed between the ink head 2 and the workpiece).

SUMMARY

A freedom degree of the arrangement of an edge position of the print pattern (functional film) is increased by enhancing the resolution, thereby increasing a freedom degree of design of the printing. Accordingly, in order to enhance definition of the print pattern, preferably the printing is performed while the resolution is enhanced. However, in the inkjet system, there is a problem in that the printing speed is decreased with enhancing resolution to lengthen time necessary for the printing.

For example, as illustrated in FIG. 10A, a minimum printing area (pixel) of an ink drop becomes 72 μm×72 μm for the resolution of 360 dpi×360 dpi. On the other hand, as illustrated in FIG. 10B, the minimum printing area (pixel) of the ink drop becomes 36 μm×72 μm in the case that the resolution in a vertical direction is doubled like 720 dpi×360 dpi. Accordingly, time necessary for the printing is doubled, because moving speed becomes a half as long as the ejection frequency is not changed.

A limit of the ejection frequency is decided in each ink head 2. In the case that the ink is ejected at a frequency exceeding the limit ejection frequency, namely, the ink is ejected at intervals shorter than a minimum time interval at which the ink can be ejected, there is a risk that the ink drop is not ejected but a printing failure is generated.

As illustrated in FIG. 10C, the minimum printing area (pixel) of the ink drop becomes 36 μm×36 μm in the case that the resolutions in both vertical and horizontal directions are doubled like 720 dpi×720 dpi. In this case, it is necessary that, after the printing is performed once using the ink head 2, the printing be performed again while the ink head 2 and the workpiece are relatively moved by a half pitch of a distance between the nozzles 21. Accordingly, it is necessary to double the number of scan times of the ink head 2 in the vertical and horizontal directions, thereby further doubling the time necessary for the printing.

It is conceivable that the arranged ink head 2 is increased to two instead of increasing the number of scan times of the ink head 2. However, in the case that the arranged ink head 2 is increased, a mechanism that performs alignment between the ink heads 2 becomes complicated and increases production cost. Additionally, a moving stroke of the ink head 2 is possibly lengthened in order to secure a space where the two ink heads 2 are arranged, and the time necessary for the one-time scan tends to be lengthened. Therefore, in both the cases, the printing time is hardly shortened.

An object of the present invention is to provide a printing method and a printing device, in which the printing quality can be maintained without increasing the time necessary for printing even if the resolution is enhanced.

According to a first aspect of the present invention, a printing method for ejecting ink from an ink head provided with plural nozzles, and forming a print pattern in an article to be printed by moving the ink head relative to the article to be printed, the printing method includes: sending a reference signal at an interval shorter than a minimum time interval at which the ink head can eject the ink; counting at least two reference signals as one count, the reference signals being set longer than the minimum time interval; ejecting the ink every one count; forming the print pattern by collectivity of the ejected ink; and adjusting at least a final one count used to form the print pattern such that the final one count is lengthened by one or plural reference signals.

In the configuration of the first aspect, the reference signal is sent at intervals shorter than the minimum time interval at which the ink head can eject the ink, and at least two reference signals set longer than the minimum time interval is counted as one count. At least the final one count used to form the print pattern is adjusted so as to be lengthened by the one or plural reference signals, and the ink is ejected every one count. Therefore, the ink ejection timing of the ink is changed without changing the moving speed of the ink head, the desired print pattern can be printed, and the printing can be performed at the high apparent resolution. Even if a necessity to increase the number of scan times of the ink head is generated in order to enhance the resolution in the array direction of the nozzles of the ink head, the decrease in printing speed is relaxed as a whole because the printing speed is hardly decreased when the resolution is enhanced in the moving direction of the ink head.

According to a second aspect of the present invention, a printing method for ejecting ink from an ink head provided with plural nozzles, and forming a print pattern in an article to be printed by moving the ink head relative to the article to be printed, the printing method includes: sending a reference signal at an interval shorter than a minimum time interval at which the ink head can eject the ink; counting at least two reference signals as one count, the reference signals being set longer than the minimum time interval; ejecting the ink every one count; forming the print pattern by collectivity of the ejected ink; and adjusting at least a predetermined one count used to form the print pattern such that the predetermined one count is longer than other one counts except the predetermined one count by one or plural reference signals.

In the configuration of the second aspect, the reference signal is sent at intervals shorter than the minimum time interval at which the ink head can eject the ink, and at least two reference signals set longer than the minimum time interval is counted as one count. At least the predetermined one count used to form the print pattern is adjusted longer than other one counts except the predetermined one count by the one or plural reference signals, and the ink is ejected every one count. Therefore, the ink ejection timing of the ink is changed without changing the moving speed of the ink head, the desired print pattern can be printed, and the printing can be performed at the high apparent resolution. Even if a necessity to increase the number of scan times of the ink head is generated in order to enhance the resolution in the array direction of the nozzles of the ink head, the decrease in printing speed is relaxed as a whole because the printing speed is hardly decreased when the resolution is enhanced in the moving direction of the ink head.

According to a third aspect of the present invention, a printing method for ejecting ink from an ink head provided with plural nozzles, and forming a print pattern in an article to be printed by moving the ink head relative to the article to be printed, the printing method includes: sending a reference signal at an interval shorter than a minimum time interval at which the ink head can eject the ink; counting at least two reference signals as one count, the reference signals being set longer than the minimum time interval; ejecting the ink every one count; forming the print pattern by collectivity of the ejected ink; and adjusting at least a one count used to form the print pattern such that the one count is lengthened by one or plural reference signals.

In the configuration of the third aspect, the reference signal is sent at intervals shorter than the minimum time interval at which the ink head can eject the ink, and at least two reference signals set longer than the minimum time interval is counted as one count. At least the one count used to form the print pattern is adjusted so as to be lengthened by the one or plural reference signals, and the ink is ejected every one count. Therefore, the ink ejection timing is changed without changing the moving speed of the ink head, the desired print pattern can be printed, and the printing can be performed at the high apparent resolution. Even if a necessity to increase the number of scan times of the ink head is generated in order to enhance the resolution in the array direction of the nozzles of the ink head, the decrease in printing speed is relaxed as a whole because the printing speed is hardly decreased when the resolution is enhanced in the moving direction of the ink head. The time interval at which the ink is ejected is equalized, so that the ink can land on the surface of the workpiece at equal intervals to reduce a variation in thickness of the print pattern.

According to a fourth aspect of the present invention, a printing device includes: an ink head in which plural openings of nozzles ejecting ink are formed in one surface of the ink head, the ink in the nozzle being ejected from the opening, a print pattern being formed in an article to be printed by moving the ink head relative to the article to be printed; and a control device, wherein the control device includes: a reference signal sender that sends a reference signal at an interval shorter than a minimum time interval at which the ink head can eject the ink; a counter that counts at least two reference signals as one count, the reference signals being set longer than the minimum time interval; a timing adjuster that adjusts ink ejection timing; and a signal output unit that outputs an instruction signal, the instruction signal ejecting the ink every one count to form the print pattern by collectivity of the ejected ink, and the timing adjuster adjusts the ink ejection timing such that at least a final one count used to form the print pattern is lengthened by one or plural reference signals.

In the configuration of the fourth aspect, the reference signal is sent at intervals shorter than the minimum time interval at which the ink head can eject the ink, and at least two reference signals set longer than the minimum time interval is counted as one count. The ink ejection timing is adjusted such that at least the final one count used to form the print pattern is lengthened by the one or plural reference signals, and the ink is ejected every one count. Therefore, the ink ejection timing is changed without changing the moving speed of the ink head, the desired print pattern can be printed, and the printing can be performed at the high apparent resolution. Even if necessity to increase the number of scan times of the ink head is generated in order to enhance the resolution in the array direction of the nozzles of the ink head, the decrease in printing speed is relaxed as a whole because the printing speed is hardly decreased when the resolution is enhanced in the moving direction of the ink head.

According to a fifth aspect of the present invention, a printing device includes: an ink head in which plural openings of nozzles ejecting ink are formed in one surface of the ink head, the ink in the nozzle being ejected from the opening, a print pattern being formed in an article to be printed by moving the ink head relative to the article to be printed; and a control device, wherein the control device includes: a reference signal sender that sends a reference signal at an interval shorter than a minimum time interval at which the ink head can eject the ink; a counter that counts at least two reference signals as one count, the reference signals being set longer than the minimum time interval; a timing adjuster that adjusts ink ejection timing; and a signal output unit that outputs an instruction signal, the instruction signal ejecting the ink every one count to form the print pattern by collectivity of the ejected ink, and the timing adjuster adjusts the ink ejection timing such that at least a predetermined one count used to form the print pattern is longer than other one counts except the predetermined one count by one or plural reference signals.

In the configuration of the fifth aspect, the reference signal is sent at intervals shorter than the minimum time interval at which the ink head can eject the ink, and at least two reference signals set longer than the minimum time interval is counted as one count. The ink ejection timing is adjusted such that at least the predetermined one count used to form the print pattern is longer than other one counts except the predetermined one count by the one or plural reference signals, and the ink is ejected every one count. Therefore, the ink ejection timing is changed without changing the moving speed of the ink head, the desired print pattern can be printed, and the printing can be performed at the high apparent resolution. Even if a necessity to increase the number of scan times of the ink head is generated in order to enhance the resolution in the array direction of the nozzles of the ink head, the decrease in printing speed is relaxed as a whole because the printing speed is hardly decreased when the resolution is enhanced in the moving direction of the ink head.

According to a sixth aspect of the present invention, a printing device includes: an ink head in which plural openings of nozzles ejecting ink are formed in one surface of the ink head, the ink in the nozzle being ejected from the opening, a print pattern being formed in an article to be printed by moving the ink head relative to the article to be printed; and a control device, wherein the control device includes: a reference signal sender that sends a reference signal at an interval shorter than a minimum time interval at which the ink head can eject the ink; a counter that counts at least two reference signals as one count, the reference signals being set longer than the minimum time interval; a timing adjuster that adjusts ink ejection timing; and a signal output unit that outputs an instruction signal, the instruction signal ejecting the ink every one count to form the print pattern by collectivity of the ejected ink, and the timing adjuster adjusts the ink ejection timing such that at least a one count used to form the print pattern is lengthened by one or plural reference signals.

In the configuration of the sixth aspect, the reference signal is sent at intervals shorter than the minimum time interval at which the ink head can eject the ink, and at least two reference signals set longer than the minimum time interval is counted as one count. The ink ejection timing is adjusted such that at least the one count used to form the print pattern is lengthened by the one or plural reference signals, and the ink is ejected every one count. Therefore, the ink ejection timing is changed without changing the moving speed of the ink head, the desired print pattern can be printed, and the printing can be performed at the high apparent resolution. Even if a necessity to increase the number of scan times of the ink head is generated in order to enhance the resolution in the array direction of the nozzles of the ink head, the decrease in printing speed is relaxed as a whole because the printing speed is hardly decreased when the resolution is enhanced in the moving direction of the ink head.

In the above configuration of the present invention, the ink ejection timing is changed without changing the moving speed of the ink head, the desired print pattern can be printed, and the printing can be performed at the high apparent resolution. Even if a necessity to increase the number of scan times of the ink head is generated in order to enhance the resolution in the array direction of the nozzles of the ink head, the decrease in printing speed is relaxed as a whole because the printing speed is hardly decreased when the resolution is enhanced in the moving direction of the ink head.

DETAILED DESCRIPTION

Hereinafter, a preferred embodiment of the present invention will be described in detail with reference to the drawings.

First Embodiment

Figure 1:
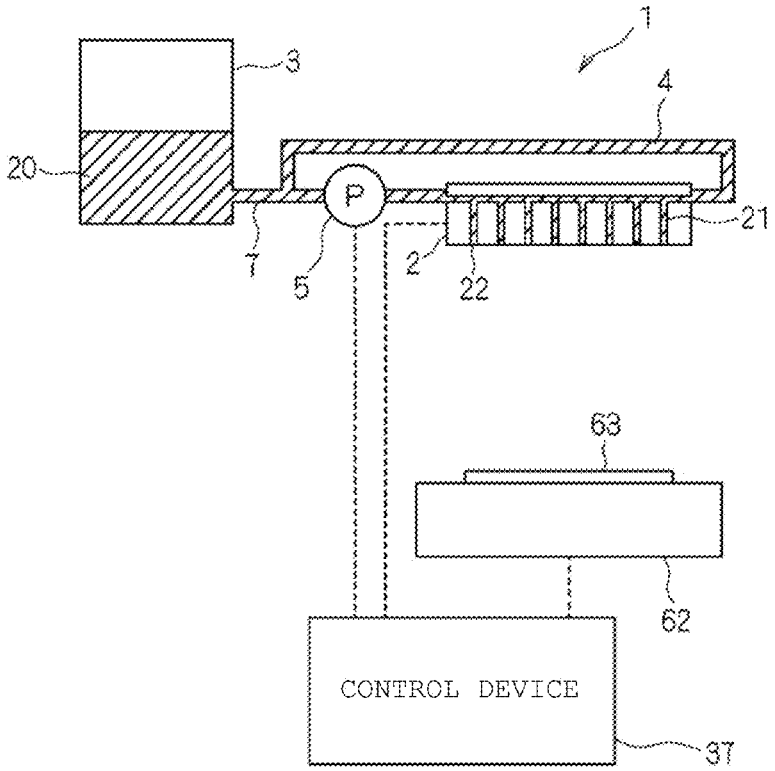
FIG. 1 is a schematic diagram illustrating a configuration of a printing device according to a first embodiment of the present invention.

FIG. 1 is a schematic diagram illustrating a configuration of a printing device according to a first embodiment of the present invention. A printing device 1 in FIG. 1 includes an ink head 2, an ink tank 3, an ink circulation route 4, a pump 5, and an ink replenishment route 7. In the ink head 2, plural openings 22 of nozzles 21 are formed in one surface of the ink head in order to eject ink 20, and the ink 20 is ejected from the opening 22 of the nozzle 21 by pressing the ink 20 in the nozzle 21 using a piezoelectric element. The openings 22 of the nozzles 21 may be arrayed in a row or plural rows. All the openings 22 of the plural nozzles 21 are not necessarily arrayed in succession.

The pump 5 is arranged in the ink circulation route 4, and supplies the ink 20 to the ink head 2 and the ink circulation route 4. The ink 20 is supplied to the ink head 2 and the ink circulation route 4 to circulate the ink 20, which prevents aggregation of a particle component of the ink 20 in the ink head 2. A control device 37 controls operation of the pump 5.

The ink 20 is reserved in the ink tank 3. For example, the ink 20 used in the printing device 1 is ink containing pigment ink metallic particles (Au, Ag, Cu, Pd, and Ni that are of electrode materials) or conductive particles, and has a configuration in which a particle component (such as pigment and metallic particles) is dispersed in a liquid component. The ink 20 may contain ceramic or resin in addition to the metallic particles and the like. Preferably a viscosity of the ink 20 is as low as 40 mPa·S or less, more preferably the viscosity of the ink 20 ranges from about 10 mPa·S to about 25 mPa·S. For example, the ink tank 3 has a capacity of about 50 mL.

The ink replenishment route 7 is a route through which the ink 20 in the ink tank 3 is supplied to the ink circulation route 4, and is connected to the ink circulation route 4 located on a suction side of the pump 5. The ink circulation route 4 is replenished with a necessary amount of ink 20 ejected from the nozzle 21 of the ink head 2 through the ink replenishment route 7.

A stage 62 on which a workpiece (article to be printed) 63 is placed is arranged below the ink head 2. The workpiece 63 is sucked and fixed onto the stage 62 so as not to move with respect to the stage 62. The stage 62 can move in three axial directions, and the placed workpiece 63 is moved according to a position of the ink 20 ejected from the nozzle 21 of the ink head 2. Specifically, the ink 20 is ejected while the stage 62 is moved in a direction orthogonal to the array of the openings 22 of the nozzles 21, which allows the printing to be performed by a one-time scan. The control device 37 controls the movement of the stage 62.

The workpiece 63 and the ink head 2 can be moved relative to each other, and either the stage 62 or the ink head 2 may be moved. A scan direction is not necessarily orthogonal to the array of the openings 22 of the nozzles 21, but the scan direction may be an oblique direction. The stage 62 is not limited to a planar shape, and the workpiece 63 is not limited to a strip shape. For example, the stage 62 may be a rotatable stage having a roll shape, and the workpiece 63 may be a long workpiece wound around the roll-shaped stage. In this case, the long workpiece moves while the roll-shaped stage rotates, which allows the printing to be performed by continuous scan.

Figure 2:
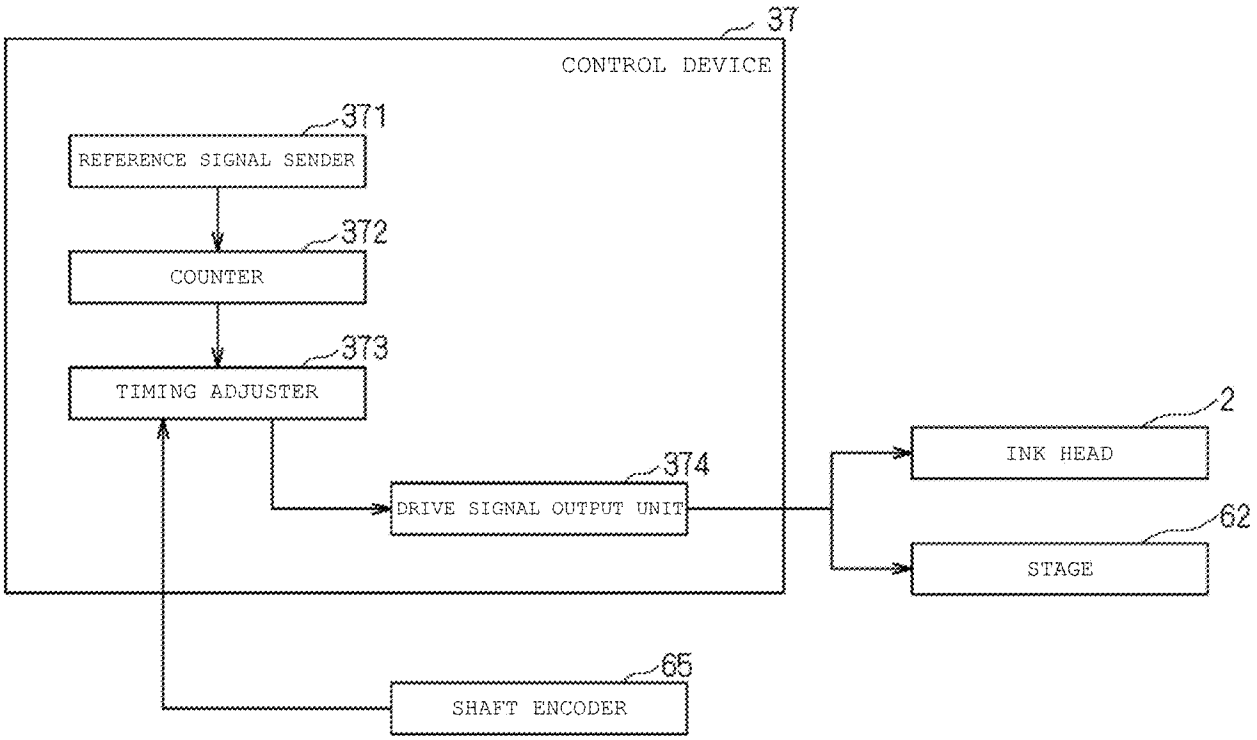
FIG. 2 is a functional block diagram illustrating a control device of the printing device of the first embodiment.

FIG. 2 is a functional block diagram illustrating the control device 37 of the printing device 1 of the first embodiment. At least the control device 37 includes a reference signal sender 371, a counter 372, a timing adjuster 373, and a drive signal output unit (signal output unit) 374.

The reference signal sender 371 sends a reference signal at intervals shorter than a minimum time interval at which the ink head 2 can eject the ink 20. The counter 372 counts at least two reference signals, which are specified so as to be longer than the minimum time interval, as one count. The timing adjuster 373 adjusts ejection timing of the ink 20 by varying the number of pulses of the reference signal included in one count. The drive signal output unit 374 outputs a drive signal (instruction signal) ejecting the ink 20 every one count to the ink head 2 and the stage 62. For example, the minimum time interval at which the ink head 2 can eject the ink 20 is $2.5\times10^{-6}$ sec (40 kHz), and the time interval of the reference signal is $1\times10^{-9}$ sec (100 MHz).

In the first embodiment, the drive signal is a signal issuing an instruction of the ejection timing of the ink 20 and a signal controlling the movement of the stage 62. The position of the stage 62 is understood by an output signal from a shaft encoder 65 attached to the stage 62, and the stage 62 is moved according to the ejection of the ink 20, which allows the printing to be performed at the desired position.

Figures 3A, 3B, 3C:
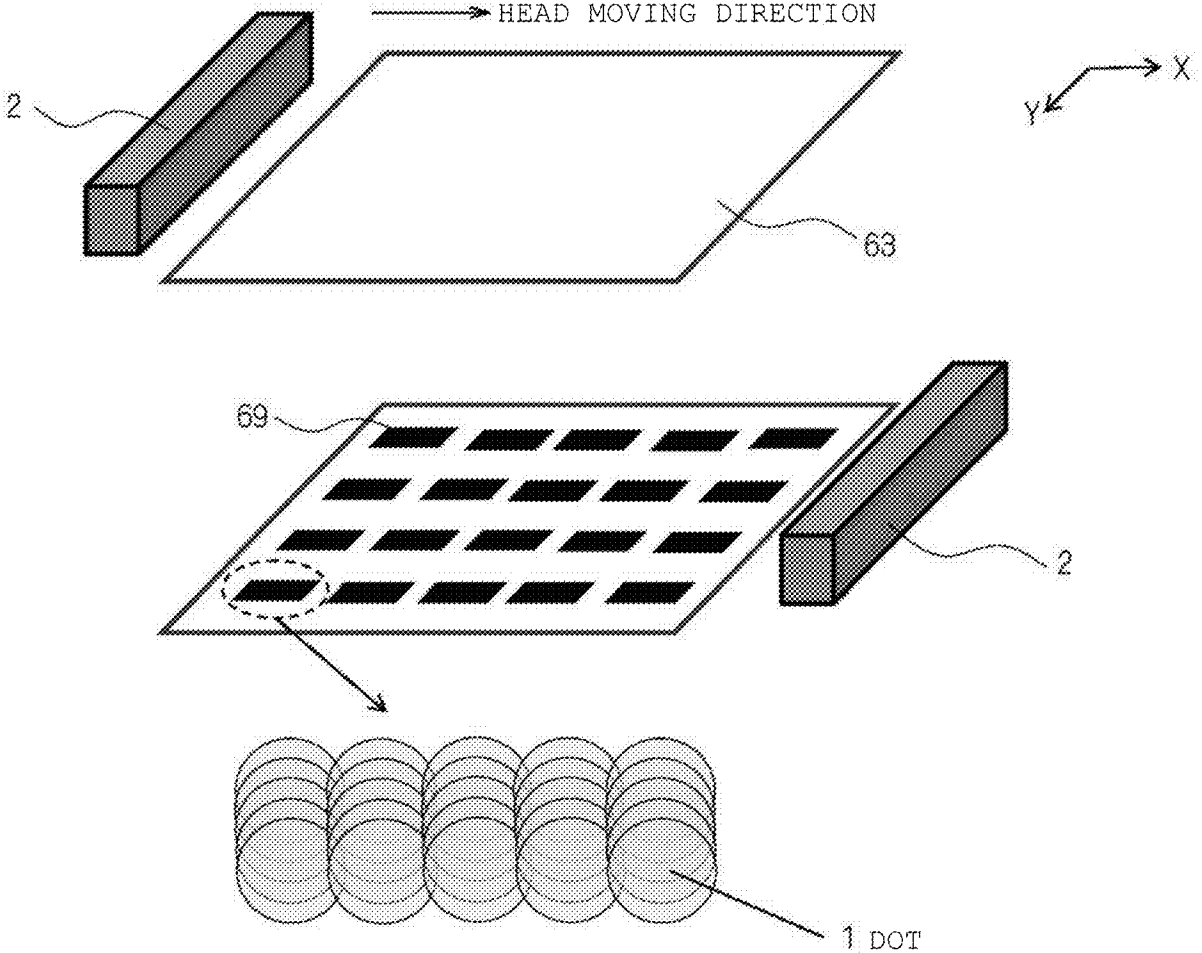
FIGS. 3A to 3C are explanatory views illustrating a printing state using an ink head of the printing device of the first embodiment.

FIGS. 3A to 3C are explanatory views illustrating a printing state using the ink head 2 of the printing device 1 of the first embodiment. FIGS. 3A to 3C illustrate the state in which a print pattern 69 is formed in the workpiece 63 using the printing device 1.

As illustrated in FIG. 3A, the ink head 2 is arranged at one end of the workpiece 63. At this point, it is assumed that an X-direction is a direction in which the ink head 2 is moved, and that a Y-direction is a direction parallel to the workpiece 63 and orthogonal to the X-direction.

As illustrated in FIG. 3B, the ink 20 is ejected every one count while the ink head 2 is moved in the X-direction. Therefore, the plural print patterns 69 are formed in the workpiece 63. The print patterns 69 are formed in a two-dimensional matrix while separated from each other on the workpiece 63. FIG. 3C is an enlarged plan view of one print pattern 69. The print pattern 69 is collectivity of dots of the ink 20. The dots of the ink 20 are ejected in a partially-overlapped manner while shifted in the X-direction and the Y-direction, thereby forming the print pattern 69.

The ejection timing of the printing device 1 of the first embodiment will be described below with reference to FIGS. 4A to 4D and 5A and 5B. FIGS. 4A to 4D are schematic diagrams illustrating a concept of an ejection timing setting in the printing device 1 of the first embodiment, and FIGS. 5A and 5B are explanatory views illustrating a detailed ejection timing setting in the printing device 1 of the first embodiment. For the sake of convenience, the counter 372 counts 1000 reference signals sent from the reference signal sender 371 as one count, and the ejection timing of the ink 20 is adjusted every one count.

Figures 4A, 4B, 4C, 4D:
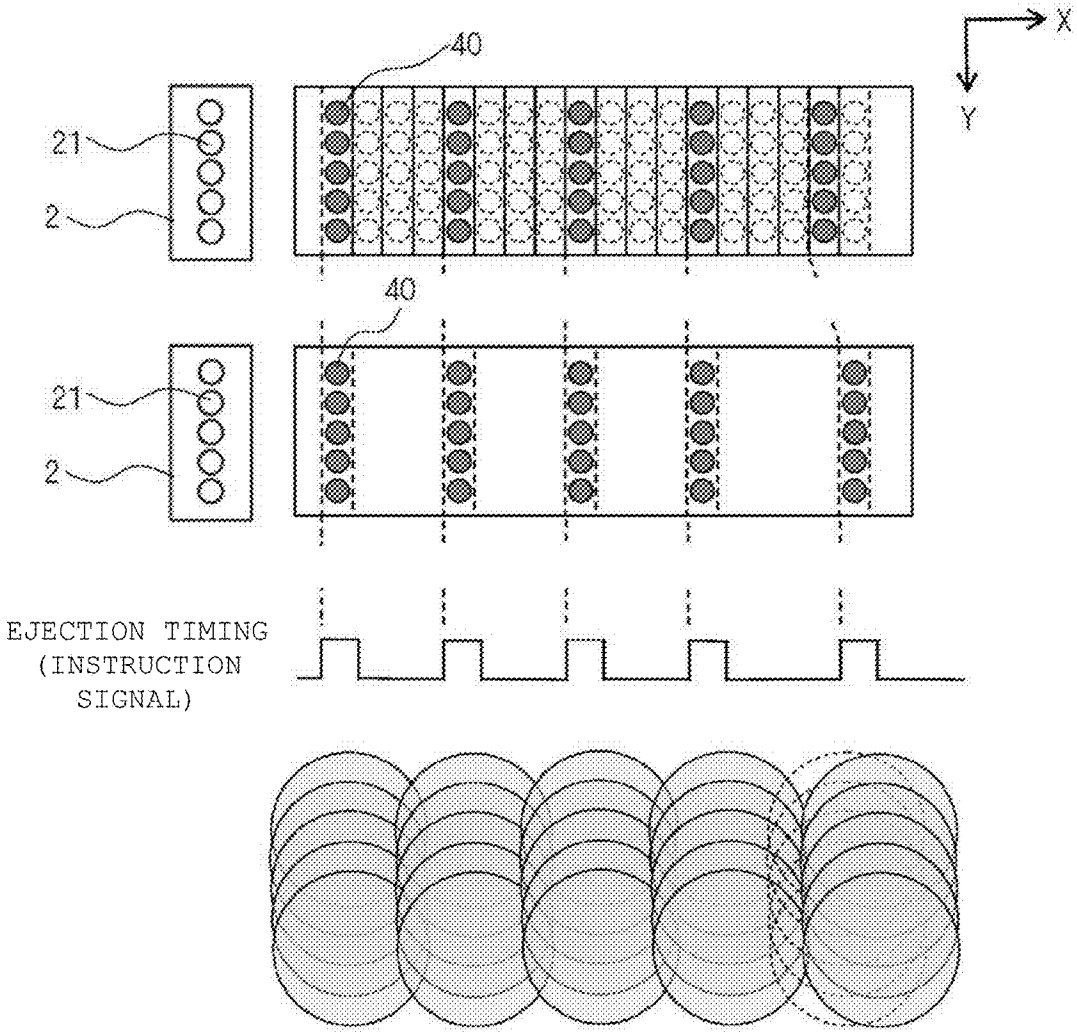
FIGS. 4A to 4D are schematic diagrams illustrating a concept of an ejection timing setting in the printing device of the first embodiment.
Figures 5A, 5B:
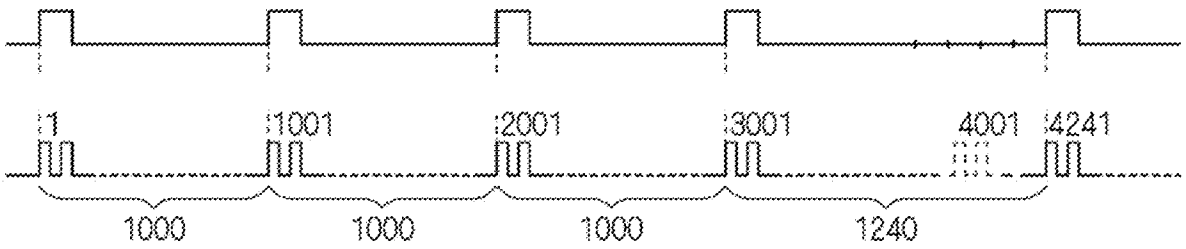
FIGS. 5A and 5B are explanatory views illustrating a detailed ejection timing setting in the printing device of the first embodiment.

In FIGS. 4A and 4B, an impact point 40 of the ink 20 is expressed in gray, and the printing is performed in an arrow direction (X-direction) in each nozzle 21 assuming that the ink head 2 has the five nozzles 21. FIG. 4A illustrates the ejection timing as a comparative example, the 1000 reference signals are counted as one count, and the ink 20 is ejected every one count. That is, as illustrated in FIG. 5B, the ejection timing is set at equal intervals such that the ink 20 is ejected by the first reference signal '1', and such that the next ink 20 is ejected by the one thousandth reference signal '1001'. FIG. 4B illustrates the ejection timing in the printing device 1 of the first embodiment, and the final one count is longer than the one count of the comparative example. FIG. 4C illustrates a signal issuing the instruction of the set ejection timing. FIG. 4D is a schematic diagram illustrating the state in which the ink 20 is actually ejected, and FIG. 4D illustrates the state in which the printing is performed every four minimum time intervals.

In the comparative example of FIG. 4A, the ink 20 is ejected only to the gray impact point 40, and the signal issuing the instruction of the ejection timing is put into an on state at equal intervals. However, in the case that a distance between the impact points 40 is varied, a necessity to enhance resolution to finely set the impact point 40 is generated, and the ink 20 is prepared so as to be able to be ejected to a broken-line area that is not colored in gray. Therefore, printing time is lengthened and the printing speed is decreased.

For this reason, in the first embodiment, as illustrated in FIGS. 5A and 5B, the ejection timing is adjusted such that only the final ejection timing is lengthened by 240 reference signals. When attention is paid to a relationship between the number of reference signals and the ejection timing, the ejection timing is set every 1000 reference signals such as '1001', '2001', '3001', . . . , and the final ejection timing is set such that the reference signal next to the reference signal '3001' is not '4001' but '4241'. Therefore, the printing can be performed similarly to the case where the resolution is enhanced four times.

For example, assuming that resolution 1440 dpi is the state in which the printing is performed every four minimum time intervals, the resolution becomes 5760 dpi in the case that the ink 20 is ejected to all the impact points 40. On the other hand, in the first embodiment, the printing is performed every four minimum time intervals in the broken-line area that is not colored in gray, but the ink 20 is not ejected, so that the printing can be performed with the apparent resolution of 5760 dpi while the printing speed is maintained at a speed corresponding to the resolution of 1440 dpi.

In the case that a certain print pattern 69 is formed, even if the ejection timing is adjusted, the ejection timing can be readjusted according to a starting position of the next print pattern 69 because a non-printing area (an area where the ink 20 is not ejected from the ink head 2) exists until the formation of the next print pattern 69 is started. For example, after the final ejection timing of a certain print pattern 69 is adjusted to '4241', the first ejection timing of the next print pattern 69 is readjusted to '8001', which allows the starting position of the next print pattern 69 to be returned to an originally-decided position.

One of the features of the first embodiment is that the reference signal sending interval is shorter than the minimum time interval at which the ink head 2 can eject the ink 20. Accordingly, at least two reference signals are counted as one count, and the ejection timing can be delayed by at least one reference signal in the final one count. Therefore, the printing can be performed at high apparent resolution without decreasing the printing speed.

The adjustment of the ejection timing is not limited to the final one count of the print pattern 69, but the ejection timing may be adjusted in plural counts including the final one count. For example, the ejection timing of the final two or three counts may be adjusted so as to be lengthened by one or plural reference signals.

As described above, in the first embodiment, the ejection timing of the ink 20 is changed without changing the moving speed of the ink head 2, the desired print pattern can be printed, and the printing can be performed at the high apparent resolution. Even if the necessity to increase the number of scan times of the ink head 2 is generated in order to enhance the resolution in the array direction of the nozzles 21 of the ink head 2, the decrease in printing speed is relaxed as a whole because the printing speed is hardly decreased when the resolution is enhanced in the moving direction of the ink head 2.

Figures 6A, 6B:
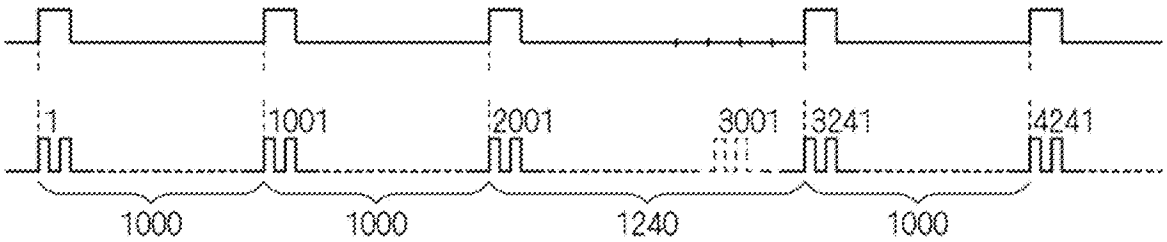
FIGS. 6A and 6B are explanatory views illustrating another detailed ejection timing setting in the printing device of the first embodiment.

The change in ejection timing is not limited to the final one count. FIGS. 6A and 6B are explanatory views illustrating another detailed ejection timing setting in the printing device 1 of the first embodiment.

As illustrated in FIGS. 6A and 6B, the ejection timing is adjusted in not the final one count but only the third count so as to be lengthened by 240 reference signals. When attention is paid to the relationship between the number of reference signals and the ejection timing, the ejection timing is set by the reference signals '1001', '2001', '3241', and '4241', . . . . The ejection timing of the third count is set such that the reference signal next to the reference signal '2001' is not '3001' but '3241', and the ejection timing of the fourth count is set such that the one thousandth reference signal becomes '4241'. Thus, the adjustment is made such that the predetermined one count forming the print pattern 69 is longer than other counts except the predetermined one count by one or plural reference signals, which allows the printing to be performed similarly to the case where the resolution is enhanced four times.

Figures 7A, 7B:
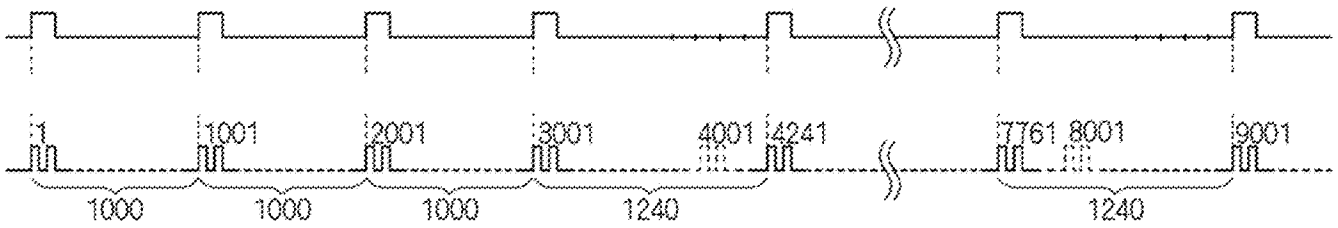
FIGS. 7A and 7B are explanatory views illustrating still another detailed ejection timing setting in the printing device of the first embodiment.

After one print pattern 69 is formed, the ejection timing of the first one count may be brought forward in order to form the next print pattern 69. FIGS. 7A and 7B are explanatory views illustrating still another detailed ejection timing setting in the printing device 1 of the first embodiment.

As illustrated in FIGS. 7A and 7B, after one print pattern 69 is formed, in order to form the next print pattern 69, only the ejection timing of the first one count is adjusted so as to be brought forward by 240 reference signals. When attention is paid to the relationship between the number of reference signals and the ejection timing, the ejection timing is set by the reference signals '7761', '9001', . . . .

In order to form the next print pattern 69, the ejection timing of the first one count is set by not the reference signal '8001' but the reference signal '7761' so as to be brought forward by the 240 reference signals. Thus, the present invention can also be applied to the case that the first one count starts earlier in order to form the print pattern 69, and the ejection timing can be brought forward by at least one reference signal in the first one count. Therefore, the printing can be performed at high apparent resolution without decreasing the printing speed.

Second Embodiment

Because a schematic diagram illustrating a configuration of a printing device according to a second embodiment of the present invention and a functional block diagram of a control device of the second embodiment are similar to those of the first embodiment, the identical component is designated by the identical numeral, and the detailed description is neglected. The second embodiment differs from the first embodiment in that the ejection timing is delayed in all the counts corresponding to the print pattern by one or plural reference signals.

The ejection timing of the printing device 1 of the second embodiment will be described below with reference to FIGS. 8A to 8D and 9A and 9B. FIGS. 8A to 8D are schematic diagrams illustrating a concept of the ejection timing setting in the printing device 1 of the second embodiment, and FIGS. 9A and 9B are explanatory views illustrating the detailed ejection timing setting in the printing device 1 of the second embodiment. Similarly to the first embodiment, it is assumed that the counter 372 counts 1000 reference signals sent from the reference signal sender 371 as one count, and that the ejection timing of the ink 20 is adjusted every one count.

Figures 8A, 8B, 8C, 8D:
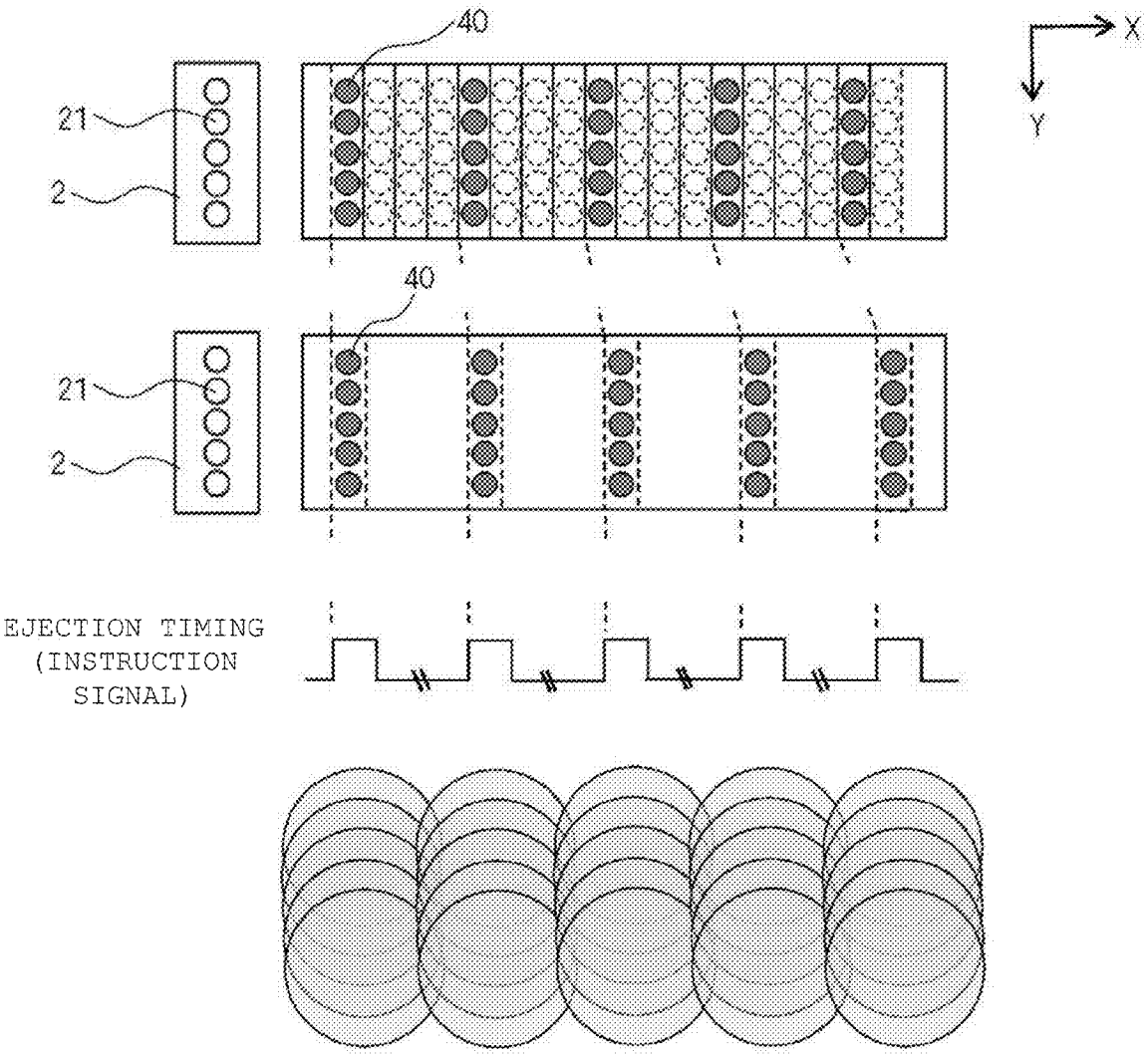
FIGS. 8A to 8D are schematic diagrams illustrating a concept of an ejection timing setting in a printing device according to a second embodiment of the present invention.
Figures 9A, 9B:
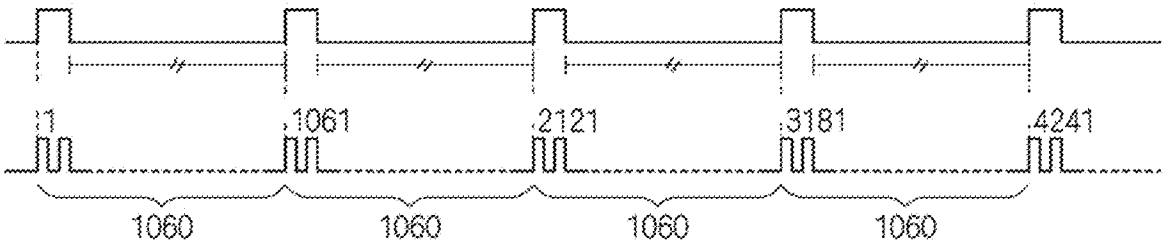
FIGS. 9A and 9B are explanatory views illustrating a detailed ejection timing setting in the printing device of the second embodiment.
Figures 10A, 10B, 10C:
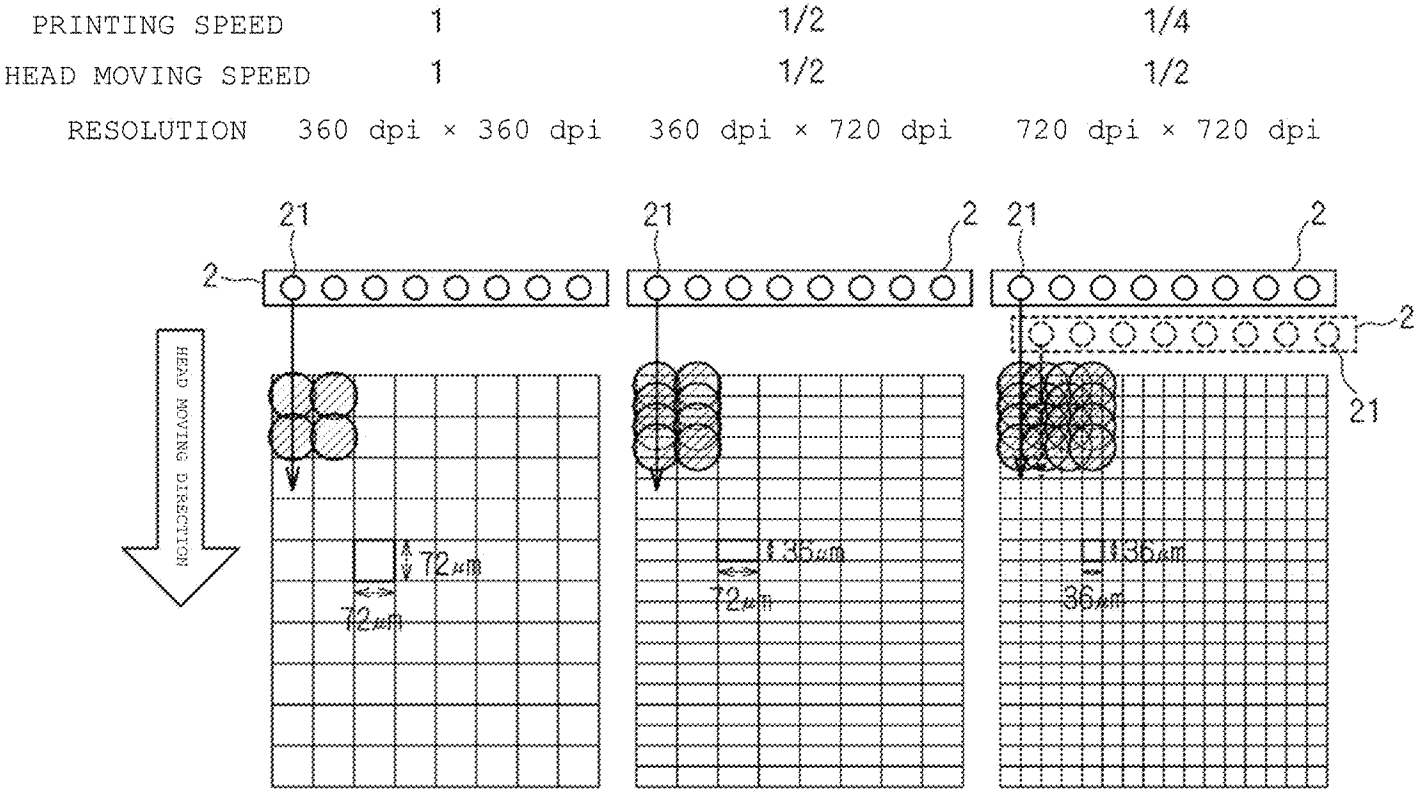
FIGS. 10A to 10C are conceptual views illustrating a relationship between resolution and printing speed in a conventional printing device.

FIG. 8A illustrates the impact point 40 colored in gray in the ejection timing of the first embodiment as a comparative example, FIG. 8B illustrates the impact point 40 colored in gray in the ejection timing of the second embodiment. In FIGS. 8A and 8B, the printing is performed in the arrow direction (X-direction) in each nozzle 21 assuming that the ink head 2 has the five nozzles 21. In the second embodiment, unlike the ejection timing delayed only in the final one count as illustrated in FIG. 8A, the ejection timing is slightly delayed every one count as illustrated in FIG. 8B, whereby the delay similar to that of the first embodiment is generated as a whole FIG. 8C illustrates the signal issuing the instruction of the set ejection timing. In the example of FIGS. 8A to 8D, the 1060 reference signals are counted as one count, and the ink 20 is ejected every one count. That is, as illustrated in FIG. 9B, the ejection timing is set such that the ink 20 is ejected by the first reference signal '1061', and such that the next ink 20 is ejected by the one thousand sixtieth reference signal '2121'.

FIG. 8D is a schematic diagram illustrating the state in which the ink 20 is actually ejected, and FIG. 8D illustrates the state in which the printing is performed every four minimum time intervals. In FIG. 8B, the ink 20 is ejected only to the gray impact point 40, and the ink 20 is ejected every one count, namely, at a time point the signal issuing the instruction of the ejection timing becomes the on state.

In the first embodiment, the ejection timing is adjusted such that only the final ejection timing is lengthened by 240 reference signals. When attention is paid to the relationship between the number of reference signals and the ejection timing, the ejection timing is set every 1000 reference signals such as '1001', '2001', '3001', . . . , and the final ejection timing is set such that the reference signal next to the reference signal '3001' is not '4001' but '4241'. Therefore, the printing can be performed in the printing area similar to the case that the resolution is enhanced four times.

On the other hand, in the second embodiment, the ejection timing is slightly delayed every one count to generate the delay similar to the case that only the final ejection timing is delayed like the first embodiment, and the instruction signal becomes the on state in the timing of equally dividing the whole time such that each count can eject the ink 20 at constant intervals (equal intervals).

FIGS. 9A and 9B illustrate the instruction signal and the reference signal for the ejection timing in the second embodiment. In the second embodiment, each 60 reference signals in the 240 reference signals, by which the final ejection timing is delayed in the first embodiment, are distributed to each count. That is, the ejection timing is set such that each count becomes 1060 reference signals.

As illustrated in FIGS. 9A and 9B, in the second embodiment, the ejection timing is set to the reference signals '1', '1061', '2121', and '3181', and the final ejection timing is delayed to the reference signal '4241'. The delay similar to the first embodiment is generated by slightly delaying the ejection timing every one count.

For example, assuming that resolution 1440 dpi is the state in which the printing is performed every four minimum time intervals, the resolution becomes 5760 dpi in the case where the ink 20 is ejected to all the impact points 40. Even in the second embodiment, similarly to the first embodiment, the printing is performed every four minimum time intervals in the broken-line area that is not colored in gray in FIG. 8B, but the ink 20 is not ejected, so that the printing can be performed with the apparent resolution of 5760 dpi while the printing speed is maintained at a speed corresponding to the resolution of 1440 dpi.

One of the features of the second embodiment is that the reference signal sending interval is shorter than the minimum time interval at which the ink head 2 can eject the ink 20. Accordingly, at least two reference signals are counted as one count, and the ejection timing can be delayed by at least one reference signal every one count. Therefore, the printing can be performed at a high apparent resolution without decreasing the printing speed.

The length of one count is adjusted in the case that a certain print pattern 69 is formed, and the length of one count can be readjusted in the case that the next print pattern 69 is formed. For example, after the length of one count is adjusted to '1060' in the case that a certain print pattern 69 is formed, the length of one count is readjusted to '1000' in the case that the next print pattern 69 is formed, which allows the time interval of one count to be returned to the original one.

As described above, in the second embodiment, the ejection timing of the ink 20 is changed without changing the moving speed of the ink head 2, the desired print pattern can be printed, and the printing can be performed at the high apparent resolution. Even if the necessity to increase the number of scan times of the ink head 2 is generated in order to enhance the resolution in the array direction of the nozzles 21 of the ink head 2, the decrease in printing speed is relaxed as a whole because the printing speed is hardly decreased when the resolution is enhanced in the moving direction of the ink head 2. The time interval at which the ink 20 is ejected is equalized, so that the ink 20 can land on the surface of the workpiece 63 at equal intervals to reduce a variation in thickness of the print pattern 69.

Various changes can be made without departing from the scope of the present invention. The impact point 40 of the first and second embodiments are described only by way of example, and the present invention can be applied as long as the final or each ejection timing can be delayed by one or plural reference signals shorter than the minimum time interval.

What is claimed is:

1. A printing method for ejecting ink from an ink head provided with a plurality of nozzles, and forming a print pattern in an article to be printed by moving the ink head relative to the article to be printed, the printing method comprising:

sending a reference signal at an interval shorter than a minimum time interval at which the ink head ejects the ink, wherein the minimum time interval is an inverse of a limit of an ejection frequency of the ink head, which is determined based on the structure of the ink head;

counting at least two reference signals as one count, the reference signals being set longer than the minimum time interval;

ejecting the ink every one count;

forming the print pattern by a collectivity of the ejected ink; and adjusting at least a final one count used to form the print pattern such that the final one count is lengthened by one or a plurality of reference signals.

2. A printing method for ejecting ink from an ink head provided with a plurality of nozzles, and forming a print pattern in an article to be printed by moving the ink head relative to the article to be printed, the printing method comprising:

sending a reference signal at an interval shorter than a minimum time interval at which the ink head ejects the ink, wherein the minimum time interval is an inverse of a limit of an ejection frequency of the ink head, which is determined based on the structure of the ink head;

counting at least two reference signals as one count, the reference signals being set longer than the minimum time interval;

ejecting the ink every one count;

forming the print pattern by a collectivity of the ejected ink; and adjusting at least a predetermined one count used to form the print pattern such that the predetermined one count is longer than other one counts except the predetermined one count by one or a plurality of reference signals.

3. A printing method for ejecting ink from an ink head provided with a plurality of nozzles, and forming a print pattern in an article to be printed by moving the ink head relative to the article to be printed, the printing method comprising:

sending a reference signal at an interval shorter than a minimum time interval at which the ink head ejects the ink, wherein the minimum time interval is an inverse of a limit of an ejection frequency of the ink head, which is determined based on the structure of the ink head;

counting at least two reference signals as one count, the reference signals being set longer than the minimum time interval;

ejecting the ink every one count;

forming the print pattern by a collectivity of the ejected ink; and adjusting at least a one count used to form the print pattern such that the one count is lengthened by one or a plurality of reference signals.

4. A printing device comprising:

an ink head in which a plurality of openings of nozzles ejecting ink are formed in one surface of the ink head, the ink in the nozzle being ejected from the opening, a print pattern being formed in an article to be printed by moving the ink head relative to the article to be printed; and a control device, wherein the control device includes:

a reference signal sender that sends a reference signal at an interval shorter than a minimum time interval at which the ink head ejects the ink, wherein the minimum time interval is an inverse of a limit of an ejection frequency of the ink head, which is determined based on the structure of the ink head;

a counter that counts at least two reference signals as one count, the reference signals being set longer than the minimum time interval;

a timing adjuster that adjusts ink ejection timing; and a signal output unit that outputs an instruction signal, the instruction signal ejecting the ink every one count to form the print pattern by a collectivity of the ejected ink, and the timing adjuster adjusts the ink ejection timing such that at least a final one count used to form the print pattern is lengthened by one or a plurality of reference signals.

5. A printing device comprising:

an ink head in which a plurality of openings of nozzles ejecting ink are formed in one surface of the ink head, the ink in the nozzle being ejected from the opening, a print pattern being formed in an article to be printed by moving the ink head relative to the article to be printed; and a control device, wherein the control device includes:

a reference signal sender that sends a reference signal at an interval shorter than a minimum time interval at which the ink head ejects the ink, wherein the minimum time interval is an inverse of a limit of an ejection frequency of the ink head, which is determined based on the structure of the ink head;

a counter that counts at least two reference signals as one count, the reference signals being set longer than the minimum time interval;

a timing adjuster that adjusts ink ejection timing; and a signal output unit that outputs an instruction signal, the instruction signal ejecting the ink every one count to form the print pattern by a collectivity of the ejected ink, and the timing adjuster adjusts the ink ejection timing such that at least a predetermined one count used to form the print pattern is longer than other one counts except the predetermined one count by one or a plurality of reference signals.

6. A printing device comprising:

an ink head in which a plurality of openings of nozzles ejecting ink are formed in one surface of the ink head, the ink in the nozzle being ejected from the opening, a print pattern being formed in an article to be printed by moving the ink head relative to the article to be printed; and a control device, wherein the control device includes:

a reference signal sender that sends a reference signal at an interval shorter than a minimum time interval at which the ink head ejects the ink, wherein the minimum time interval is an inverse of a limit of an ejection frequency of the ink head, which is determined based on the structure of the ink head;

a counter that counts at least two reference signals as one count, the reference signals being set longer than the minimum time interval;

a timing adjuster that adjusts ink ejection timing; and a signal output unit that outputs an instruction signal, the instruction signal ejecting the ink every one count to form the print pattern by a collectivity of the ejected ink, and the timing adjuster adjusts the ink ejection timing such that at least a one count used to form the print pattern is lengthened by one or a plurality of reference signals.

7. The printing method of claim 1, wherein a printing resolution of the printing method is set based on the minimum time interval.

8. The printing method of claim 2, wherein a printing resolution of the printing method is set based on the minimum time interval.

9. The printing method of claim 3, wherein a printing resolution of the printing method is set based on the minimum time interval.

10. The printing device of claim 4, wherein a printing resolution of the printing device is set based on the minimum time interval.

11. The printing device of claim 5, wherein a printing resolution of the printing device is set based on the minimum time interval.

12. The printing device of claim 6, wherein a printing resolution of the printing device is set based on the minimum time interval.

* * * * *